US005414230A

United States Patent [19]

Nieuwendijk et al.

[11] Patent Number: 5,414,230

[45] Date of Patent: May 9, 1995

[54] SILENCER ARRANGEMENT FOR COMBUSTION ENGINES

[75] Inventors: Joris A. M. Nieuwendijk; Johannes W. T. Bax, both of Eindhoven, Netherlands; Andre J. De Wachter, Herzele, Belgium

[73] Assignee: U.S. Philips Corporation, New York, N.Y.

[21] Appl. No.: 123,271

[22] Filed: Sep. 17, 1993

[30] Foreign Application Priority Data

Sep. 23, 1992 [EP] European Pat. Off. ..... 92202914

[51] Int. Cl.[6] ..... F01N 1/06

[52] U.S. Cl. ..... 181/206; 381/71

[58] Field of Search ..... 181/206, 156, 199, 151, 181/152; 381/71

[56] References Cited

U.S. PATENT DOCUMENTS

| | | | |
|---|---|---|---|
| 5,025,885 | 6/1991 | Froeschle | 181/156 |
| 5,173,575 | 12/1992 | Furukawa | 181/160 |
| 5,229,556 | 7/1993 | Geddes | 181/206 |

FOREIGN PATENT DOCUMENTS

| | | |
|---|---|---|
| 0429121 | 5/1991 | European Pat. Off. . |
| 0481450 | 4/1992 | European Pat. Off. . |

*Primary Examiner*—M. L. Gellner
*Assistant Examiner*—Patrick J. Stanzione
*Attorney, Agent, or Firm*—Robert J. Kraus

[57] ABSTRACT

A silencer arrangement for a combustion engine (1) whose exhaust gases are discharged via an exhaust pipe (3) comprises a microphone (9), a tachometer (11) for the engine speed, a control unit (13) and a loudspeaker enclosure (19). The loudspeaker enclosure accommodates two loudspeakers (15, 17) secured to a partition (21). The partition divides the volume of the loudspeaker enclosure into two subvolumes (23, 25). The subvolumes communicate with one another via a tube (27) in order to reduce the electric power required to obtain the desired acoustic power of the sound emitted by the loudspeaker enclosure. One of the subvolumes (25) is acoustically coupled to a tube (33). One end (35) of the tube is situated near the end (7) of the exhaust pipe (3). The sound issuing from the loudspeaker enclosure via the tube interferes with the exhaust-gas sound. A Helmholtz resonator (41) is acoustically coupled to the tube (33) in order to suppress undesired resonances in the tube (33). The Helmholtz resonator contains such an amount of an acoustic damping material (43) in the form of glass wool or rock wool that the quality factor $Q_{Helmh.}$ of the Helmholtz resonator lies between the values 1 and 3.

6 Claims, 2 Drawing Sheets

SILENCER ARRANGEMENT FOR COMBUSTION ENGINES

BACKGROUND OF THE INVENTION

The invention relates to a silencer arrangement for combustion engines whose exhaust gases are discharged via an exhaust pipe, which silencer arrangement comprises a loudspeaker enclosure, in which a partition and a loudspeaker device secured to the partition are arranged, the partition dividing a volume bounded by the loudspeaker enclosure into two subvolumes, an acoustic tube secured to the loudspeaker enclosure and acoustically coupled to one of the subvolumes, one end of the acoustic tube being situated near one end of the exhaust pipe, a Helmholtz resonator, and a control unit which drives the loudspeaker device in response to measurement signals.

A silencer of the type defined in the opening paragraph is known from EP 0,481,450 A1. By means of the control unit the sound at the end of the exhaust pipe is analyzed, amplified and phase-shifted. The control unit subsequently drives a loudspeaker, which emits sound via the acoustic tube, which sound interferes with the sound produced by the exhaust gas and thus reduces the noise. The Helmholtz resonator is formed by the loudspeaker enclosure. If the acoustic tube is long (approximately 20 cm or longer) the air in the tube no longer behaves as an acoustic mass and the tube functions as an acoustic transmission channel. This leads to resonances in the acoustic tube, which give rise to distortions of the acoustic output signal and further lead to sharp peaks and dales in the transfer characteristic of the arrangement. This has the drawback that the resulting acoustic resonance peaks will be situated too close to the operating range, which gives rise to distortion and phase errors in the operating range. In order to produce an adequate acoustic power for suppressing the exhaust noise the loudspeakers require a substantial electric power.

It is an object of the invention to provide a silencer arrangement of the type defined in the opening paragraph, enabling the attenuation of the exhaust-gas signal to be improved by simple means and enabling the use of loudspeakers having a smaller power handling capacity. To this end the silencer arrangement in accordance with the invention is characterised in that the Helmholtz resonator is acoustically coupled to the tube via an opening in a side wall of the tube, the Helmholtz resonator containing an acoustic damping material and the quality factor $Q_{Helmh.}$ of the Helmholtz resonator being greater than 1 and smaller than 3, and the two subvolumes communicate acoustically with one another via a port in the partition. The coupling of the Helmholtz resonator to the acoustic tube via an opening in the side wall of the tube reduces undesired distortions and phase errors in the acoustic output signal. As a result of this, the acoustic resonance peaks outside the operating range are reduced, which improves the performance of the silencer arrangement. Since the two subvolumes communicate via a port larger loudspeakers can be used with the same enclosure volume, so that the acoustic power increases or the same acoustic power can be produced with less electric power. A port is to be understood to mean a tube or an opening. For the definition and determination of the quality factor $Q_{Helmh.}$ reference is made to EP 0,429,121 A1.

A Helmholtz resonator which is acoustically coupled to a long tube via an opening in a side wall of the tube is known per se from EP 0,429,121 A1. Moreover, a loudspeaker enclosure having two subvolumes communicating via an opening in a partition is known per se from U.S. Pat. No. 5,025,885. However, the use of such a loudspeaker enclosure with a Helmholtz resonator in a silencer arrangement for combustion engines is new and combines the advantages, yielding a very advantageous novel silencer arrangement for use with combustion engines. The advantages of a high acoustic power with small dimensions of the loudspeaker enclosure and the absence of resonances in the proximity of the operating range are very important for an effective operation of the silencer arrangement to be used in a car having a combustion engine, where space is important and the operating conditions :fluctuate strongly.

An embodiment of the silencer arrangement in accordance with the invention is characterised in that a further acoustic tube is secured to the loudspeaker enclosure and is acoustically coupled to one of the subvolumes, one end of the further acoustic tube being situated near one end of the exhaust pipe, and the Helmholtz resonator being acoustically coupled to the further tube via an opening in a side wall of the further tube. By the use of two tubes instead of one tube the Helmholtz resonator can be mechanically connected to both tubes, resulting in a rugged construction of the acoustic tubes with the Helmholtz resonator.

A further embodiment is characterized in that the loudspeaker enclosure is mainly made of a non-metallic material such as wood or a synthetic material. This has the advantage that the loudspeaker enclosure can be manufactured by means of a method known from the production of loudspeaker enclosures for audio purposes. Both the loudspeaker and the enclosure should be protected from excessive heating by arranging them at adequate distances from hot parts and, if required, by the use of thermally insulating materials and tubes.

The invention also relates to a vehicle comprising a silencer arrangement as characterized above, which vehicle is characterized in that the loudspeaker enclosure is disposed in an inner space of the vehicle, which space is isolated from the exhaust pipe by at least one wall.

These and other aspects of the invention will become apparent from and elucidated on the basis of the embodiments described hereinafter.

BRIEF DESCRIPTION OF THE DRAWING

The invention will now be described in more detail, by way of example, with reference to the drawing figures, in which.

DESCRIPTION OF THE PREFERRED EMBODIMENTS

Figure 1:
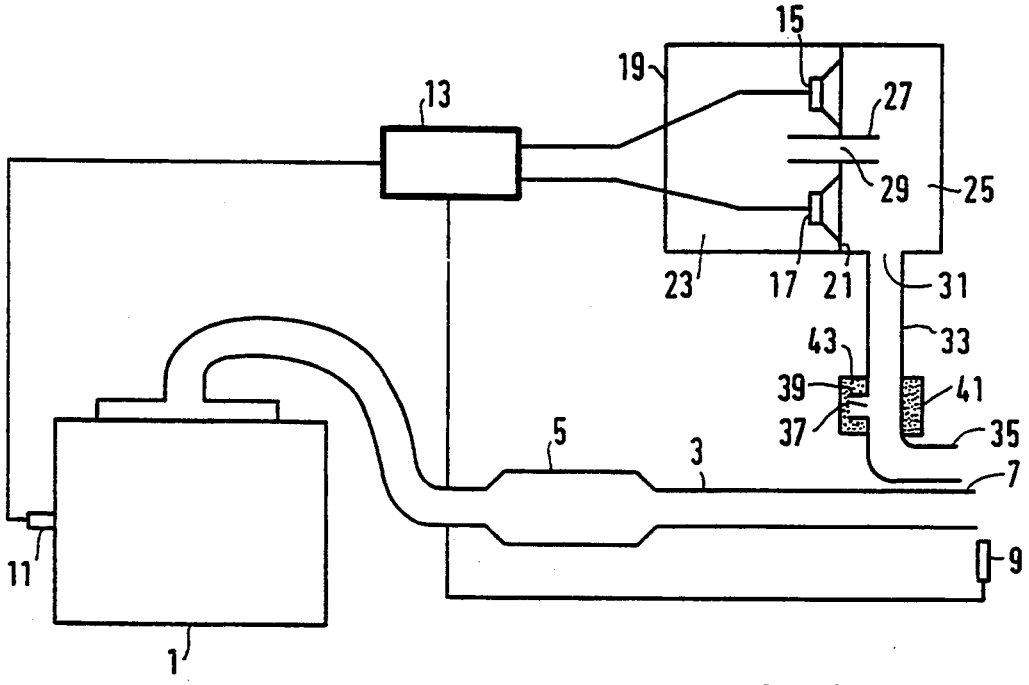
FIG. 1 shows diagrammatically a combustion engine having an exhaust pipe and a first embodiment of the silencer arrangement in accordance with the invention.

FIG. 1 shows diagrammatically a combustion engine 1 having an exhaust pipe 3. In the exhaust pipe 3 a passive acoustic silencer 5 is arranged to suppress the high-frequency noise produced by the exhaust gases. Near the end 7 of the exhaust pipe 3 a microphone 9 is arranged to measure the sound. The measurement signal from the microphone 9 and from a tachometer 11 for the engine speed are applied to a control unit 13. The control unit processes the measurement signals and drives a loudspeaker device comprising loudspeakers 15, 17 accommodated in a loudspeaker enclosure 19. The measurement signals vary as a function of the changing operating conditions of the combustion engine. For this reason the control unit 13 also regularly adapts the drive to the loudspeakers 15, 17. The loudspeaker enclosure 19 has a partition 21 dividing the volume of the loudspeaker enclosure into a first subvolume 23 of 5 liters and a second subvolume 25 of 3.5 liters. The subvolumes 23, 25 communicate with one another via a pipe 27 arranged in an opening 29 in the partition 21. The pipe 27 has a diameter of 47 mm and a length of approximately 14 cm. The two loudspeakers 15, 17 are secured to the partition 21 at the location of two further openings in the partition. The loudspeakers 15, 17 have a diaphragm of 7 inch diameter, a moving mass of approximately 10 grammes and a resonant frequency of 58 Hz, their $Q_T$ (overall quality factor with open resonant frequency) being approximately 0.15. An opening 31 in the loudspeaker enclosure 19 provides the acoustic coupling between the subvolume 25 and an acoustic tube 33. The acoustic tube 33 has a diameter of 100 mm and a pathlength of approximately 22 cm. The acoustic tube 33 has one end secured to the loudspeaker enclosure 19 and its other end is situated near the end 7 of the exhaust pipe 3. An opening 37 is formed in a wall of the tube 33. At the location of this opening 37 a short pipe 39 is secured to the tube 33 in order to provide an acoustic coupling between a Helmholtz resonator 41 and the tube 33. The short pipe 39 has a diameter of 66 mm and a length of approximately 30 min. The central axis of the pipe 39 is situated at a distance of approximately 9 cm from the end 35 of the tube 33. The Helmholtz resonator 41 has a volume of approximately 0.5 to 1 liter. The Helmholtz resonator 41 contains such an amount of an acoustic damping material 43 in the form of glass wool or rock wool that the quality factor $Q_{Helmh.}$ of the Helmholtz resonator lies between the values 1 and 3 and is, for example, 2. The loudspeaker enclosure 19 is made of a non-metallic material such as wood or a synthetic material, for example polycarbonate, polypropylene etc. The material of the Helmholtz resonator 41 and the tube 33 is preferably a metal, because these parts are situated comparatively close to the exhaust pipe 3.

Figure 2:
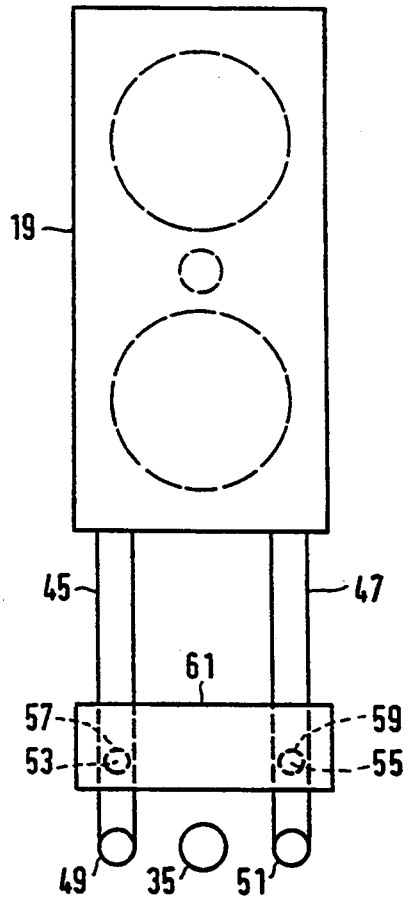
FIG. 2 shows a second embodiment of the silencer arrangement in accordance with the invention.

In the embodiment shown in FIG. 2 two tubes 45, 47 are secured to the loudspeaker enclosure 19 and the ends 49, 51 of the tubes are situated at opposite sides of the end 35 of the exhaust pipe. The tubes 45, 47 have a diameter of 70 mm and a pathlength of approximately 22 cm. Both tubes 45, 47 are acoustically coupled to a common Helmholtz resonator 61 via openings 53, 55 in the walls of the tube and via short pipes 57, 59. The short pipes 57, 59 have a diameter of 47 mm and a length of approximately 35 min. The central axes of the pipes 57, 59 are situated at a distance of approximately 9 cm from the ends 49, 51 of the tubes 45, 47. The volume of the Helmholtz resonator 61 is again 0.5 to 1 liter.

Figure 3:
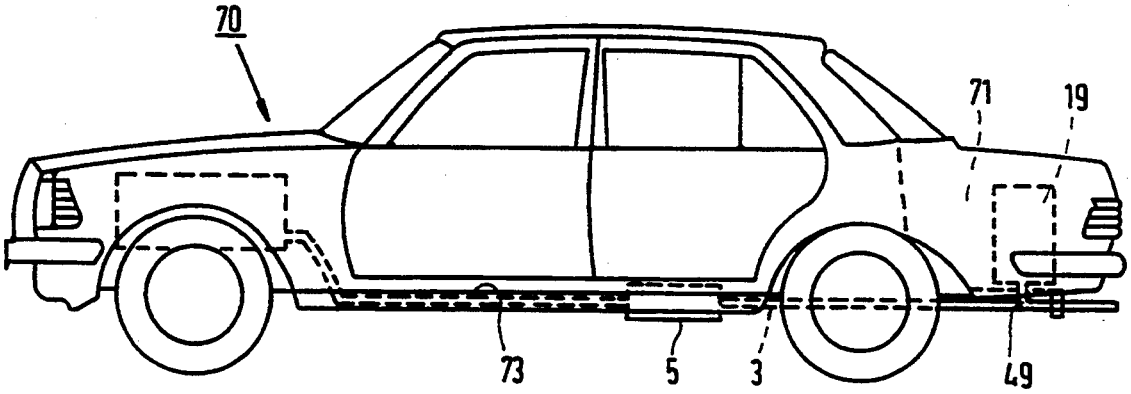
FIG. 3 is a side view of a passenger vehicle in accordance with the invention.
Figure 4:
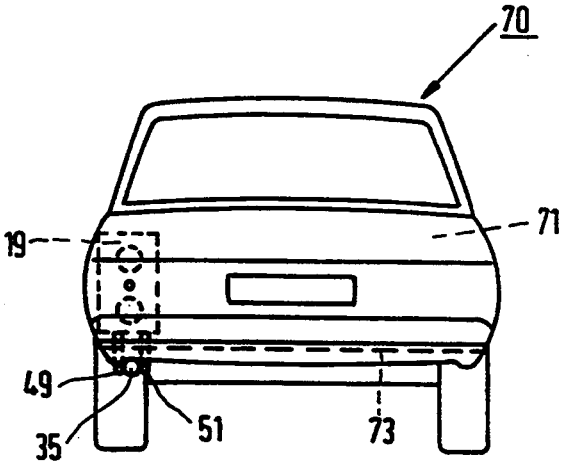
FIG. 4 is a rear view of the vehicle shown in FIG. 3.

In the passenger car 70 shown in FIGS. 3 and 4 the loudspeaker enclosure 19 has been arranged in the trunk 71 of the car. Thus, the loudspeaker enclosure is isolated from the exhaust pipe 7 by the bottom plate 73.

If required, the loudspeaker enclosure 19 may be isolated from parts of the car by elastic and/or damping means to reduce the transmission of structural-borne sounds. The tubes 47 and 49 may be detachably connected to the loudspeaker enclosure in order to simplify mounting. The tubes 47 and 49 may be passed through the bottom plate 73 of the car via resilient and/or damping and/or thermally insulating feed-through means. If desired, the Helmholtz resonator 41 may be constructed so as to form part of the feed-through means.

The present embodiments of the silencer arrangement for combustion engines can be used, for example, for actively silencing the exhaust gas noise of a car. The loudspeaker enclosure containing the loudspeakers can be accommodated, for example, in the trunk of a car, the tubes extending to the exhaust pipe through the trunk bottom. The loudspeaker enclosure is then mechanically isolated completely from the exhaust pipe, which enables the loudspeaker enclosure to be made of a cheap synthetic material having suitable acoustic properties. By arranging the loudspeakers remote from the exhaust pipe the loudspeakers need not comply with stringent requirements as regards the resistance to high temperatures and the moisture resistance.

Although the invention has been described with reference to the drawings this does not imply that the invention is limited to the embodiments shown in the drawings. The invention likewise relates to all embodiments which deviate from those shown in the drawings within the scope defined by the claims.

We claim:

1. A silencer apparatus for a combustion engine which discharges exhaust gases from an end of an exhaust pipe, said silencer arrangement comprising:

a. a loudspeaker enclosure having a partition dividing said enclosure into first and second subvolumes, said partition having a port through which said first and second subvolumes communicate;

b. a loudspeaker device disposed in the enclosure and secured to the partition;

c. at least one acoustic tube having a first end acoustically coupled to one of the first and second subvolumes, having a second end situated near the end of the exhaust pipe, and having an opening disposed in a sidewall of said tube between said first and second ends;

d. a Helmholtz resonator acoustically coupled to the acoustic tube via the opening, said Helmholtz resonator including an acoustic damping material and having a quality factor $Q_{Helm}$ with a value between 1 and 3;

e. sensing means for producing at least one measurement signal which varies as a function of changing operating conditions of the combustion engine;

f. a control unit electrically connected to the loudspeaker device for driving said device in response to the at least one measurement signal.

2. A silencer apparatus as in claim 1 where the at least one acoustic tube comprises first and second acoustic tubes, each having a first end acoustically coupled to one of the first and second subvolumes, having a second end situated near the end of the exhaust pipe, and having an opening disposed in a sidewall of said tube between said first and second ends and acoustically coupled to the Helmholtz resonator.

3. A silencer apparatus as in claim 1 where the loudspeaker enclosure consists essentially of a non-metallic material.

4. A silencer apparatus as in claim 3 where the material comprises wood.

5. A silencer apparatus as in claim 3 where the material comprises a synthetic material.

6. A silencer apparatus as in claim 1 where the loudspeaker enclosure is disposed in an inner space of a vehicle, said space being isolated from the exhaust pipe by at least one wall means.

* * * * *